US005114061A

United States Patent [19]

Brady

[11] Patent Number: 5,114,061

[45] Date of Patent: May 19, 1992

[54] WATERPROOF POUCH RELEASABLY CLAMPABLE TO WEARING APPAREL

[76] Inventor: Thomas J. Brady, 6839 Hawkston Rd., Sylvania, Ohio 43560

[21] Appl. No.: 405,598

[22] Filed: Sep. 11, 1989

Related U.S. Application Data

[63] Continuation of Ser. No. 17,631, Feb. 24, 1987, abandoned.

[51] Int. Cl.[5] ..... A45F 5/00; A45F 5/02

[52] U.S. Cl. ..... 224/252; 224/194; 224/235

[58] Field of Search ..... 224/194, 228, 235-237, 224/240, 252, 253, 269, 901, 191, 230, 194, 236, 252, 235, 239; 206/811; 383/81, 61, 63; 24/484, 498, 530, 3 F, 3 H, 3 J, 327, 494, 500, 511, 570, 487, 571; 267/159, 164; 223/93, 99, 96

[56] References Cited

U.S. PATENT DOCUMENTS

| | | | |
|---|---|---|---|
| 1,003,711 | 9/1911 | Cunningham | 2/252 |
| 1,142,509 | 6/1915 | Ellman et al. | 2/251 |
| 1,164,010 | 12/1915 | Paull | 2/251 |
| 1,164,011 | 12/1915 | Paull | 2/251 |
| 1,603,299 | 10/1926 | Stroeken | 2/252 |
| 1,816,284 | 7/1931 | Hughes | 224/252 X |
| 2,048,344 | 7/1936 | Lillie | 224/253 |
| 2,606,587 | 8/1952 | Porter | 383/81 X |
| 3,154,239 | 10/1964 | Madsen | 383/81 |
| 3,292,223 | 12/1966 | Esposito, Jr. | 223/93 |
| 3,611,444 | 10/1971 | Rector | 2/247 |
| 3,937,373 | 2/1976 | Artz | 224/252 |
| 3,982,675 | 9/1976 | Claypool | 224/252 |
| 3,998,304 | 12/1976 | Edgerton, Jr. et al. | 190/48 |
| 4,148,422 | 4/1979 | Habler | 224/252 |
| 4,214,686 | 7/1980 | Dostourian | 224/269 |
| 4,237,583 | 12/1980 | Sullivan | 24/3 R |
| 4,266,300 | 5/1981 | Partridge | 2/247 |
| 4,421,150 | 12/1983 | Masters | 383/61 |
| 4,557,503 | 12/1985 | Linn | 24/494 |
| 4,667,374 | 5/1987 | Bianchi | 224/252 |
| 4,705,086 | 11/1987 | O'Neill | 224/269 |
| 4,763,390 | 8/1988 | Rooz | 24/487 |
| 4,884,726 | 12/1989 | Kolton et al. | 223/91 |

FOREIGN PATENT DOCUMENTS

| | | | |
|---|---|---|---|
| 372523 | 3/1923 | Fed. Rep. of Germany | 24/494 |
| 2340685 | 2/1975 | Fed. Rep. of Germany | 224/252 |
| 7800003 | 12/1978 | PCT Int'l Appl. | 24/487 |
| 61127 | 7/1926 | Sweden | 24/494 |

*Primary Examiner*—Ernest G. Cusick
*Assistant Examiner*—David J. Walczak
*Attorney, Agent, or Firm*—MacMillan, Sobanski & Todd

[57] ABSTRACT

A waterproof pouch includes a readily openable and recloseable waterproof seal protected by a closure flap having readily openable and recloseable fastening means. The pouch also includes a readily openable and closeable clamp for clamping the pouch to wearing apparel.

4 Claims, 2 Drawing Sheets

WATERPROOF POUCH RELEASABLY CLAMPABLE TO WEARING APPAREL

CROSS-REFERENCE TO RELATED APPLICATIONS

This application is a continuation of U.S. Pat. application Ser. No. 07/017,631, field Feb. 24, 1987, now abandoned.

BACKGROUND OF THE INVENTION

This invention relates generally to waterproof pouches for small personal items and, more particularly, to a waterproof pouch removably attachable to wearing apparel, such as swimsuits.

U.S. Pat. No. 1,164,011 discloses a waterproof pocket removably attachable to a bathing suit. The bathing suit is provided with a slit for receiving the pocket, and the pocket is attached to the portion of the bathing suit above the slit by four apertured knobs. The knobs are poked through the material of the bathing suit and are fastened in place on the suit by split rings inserted through the apertures in the knobs.

Other examples of bathing suits having waterproof pockets are shown in U.S. Pat. Nos. 1,142,509 and 1,603,299. Also, U.S. Pat. Nos. 1,003,711, 3,611,444, and 4,266,300 disclose detachable pockets for wearing apparel. Further, examples of waterproof pouches with multiple closure means are disclosed in U.S. Pat. Nos. 3,998,304 and 4,421,450.

SUMMARY OF THE INVENTION

The present invention provides a waterproof pouch which is readily releasably clampable to an edge portion of wearing apparel. The pouch is constructed of flexible impermeable plastic sheet material and includes a readily openable and recloseable waterproof seal protected by a closure flap having readily openable and recloseable fastening means.

In the preferred embodiment of the invention, the waterproof seal is provided by a pair of complementary sealing strips each having tongues and grooves releasably interlockable with those of the other. Also, the pouch is clamped by means of a readily openable and closeable over-center snap-acting clamp. The clamp is preferrably attached to the pouch by a separate reinforcing strip which extends over a portion of the clamp and is heat-sealed to the pouch.

The above, as well as other advantages of the present invention, will be readily apparent to one skilled in the art when the following detailed description of the invention is read in conjunction with the attached drawings.

DETAILED DESCRIPTION OF THE PREFERRED EMBODIMENT

Figure 1:
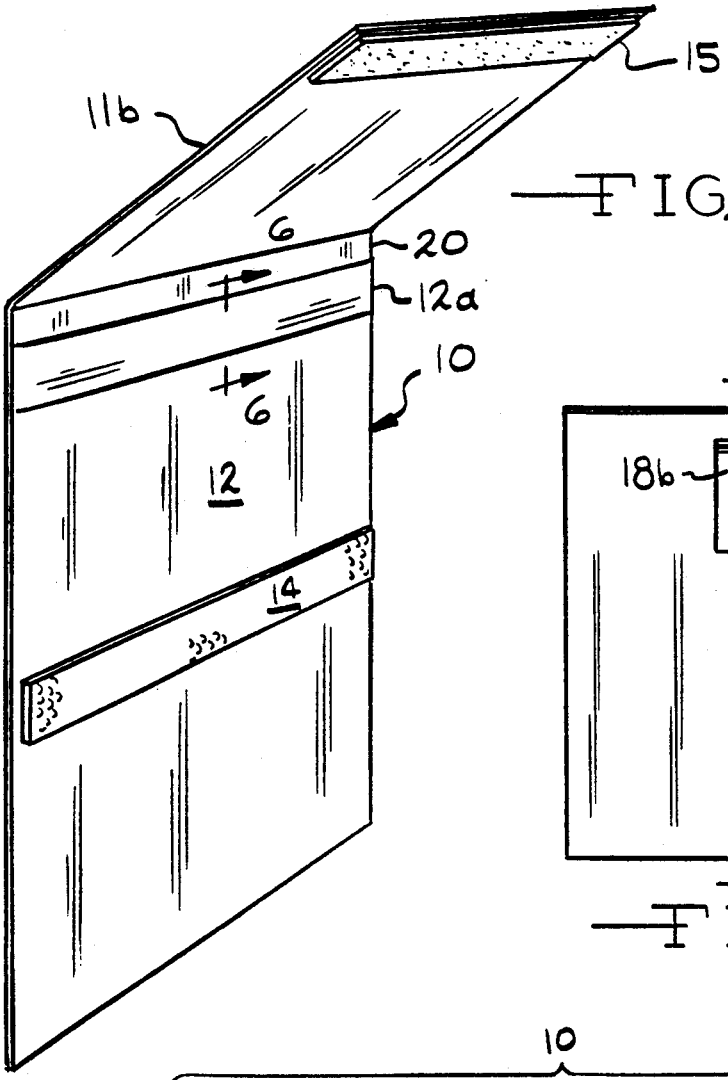
FIG. 1 is a front perspective view of a waterproof pouch constructed in accordance with the invention, a closure flap thereof being shown in an open position.
Figure 2:
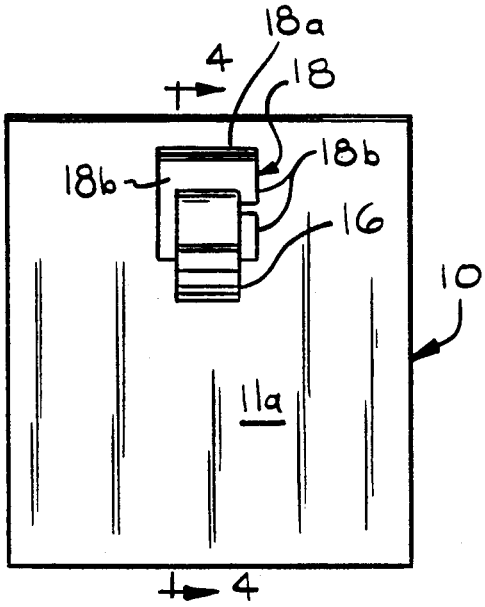
FIG. 2 is a rear elevational view of the pouch of FIG. 1, a clamp thereof being shown in a closed condition.
Figure 3:
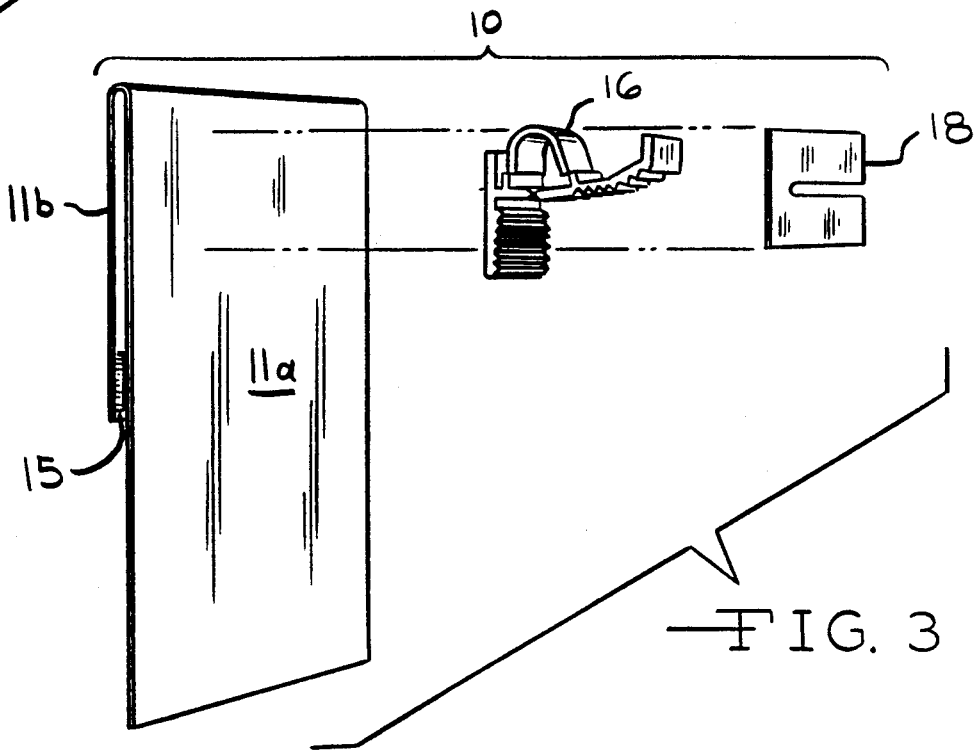
FIG. 3 is an exploded rear perspective view of the pouch of FIGS. 1 and 2, the clamp being shown in an open condition.

Referring to the drawings, FIGS. 1–4 show a waterproof pouch 10 constructed in accordance with the invention. The pouch 10 includes a flexible plastic rear wall 11*a* having an upper extension 11*b* which serves as a closure flap, and a flexible plastic front wall 12 heat-sealed or otherwise adhered to the rear wall 11*a* along lower and opposite side edge portions and forming an open-top compartment therewith.

A transversely extending fastening strip 14 is adhered to an outer side of the front wall 12 about midway between its upper and lower edges, and a complementary fastening strip 15 is adhered to an inner side of the closure flap 11*b* along an edge portion which is a lower edge portion when the flap is closed. The strip 14 is provided with small hooks and the strip 15 is provided with a wooley or looped surface. Such mating hook and loop fastening strips are available under the trademark "VELCRO". They are readily openable and recloseable.

Figure 5:
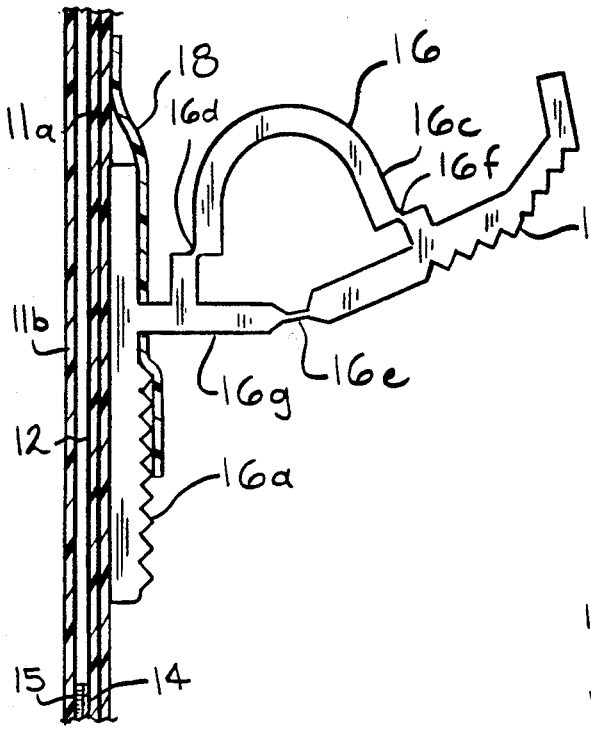
FIG. 5 is a fragmentary sectional view similar to FIG. 4, but showing the clamp in an open condition.

A clamp 16 is secured in place on the outer side of the rear wall 11*a* by a slotted rectangular piece 18 of flexible plastic heat-sealed or otherwise adhered to the rear wall 11*a* along an upper edge 18*a* and opposite side edges 18*b*. The clamp 16 may be termed a one-piece, overcenter snap-acting mechanism and is more clearly shown in FIGS. 4 and 5.

The clamp 16 is made of semi-rigid plastic in one piece, but may be considered as including three parts connected together by thin sections. Thus, a mounting base 16*a*, an operating lever 16*b*, and a generally U-shaped spring 16*c* are provided. The mounting base 16*a* is connected by a thin section 16*d* to one end of the spring 16*c* and by a thin section 16*e* to the operating lever 16*b*. The other end of the spring 16*c* is connected by a thin section 16*f* to the operating lever 16*b*. The thin sections 16*d*, 16*e*, and 16*f* act as pivotal connections, being more flexible than the remainder of the clamp 16. A fulcrum post portion 16*g* of the mounting base projects through the slot in the flexible plastic piece 18. Mating portions of the base 16*a* and the operating lever 16*b* are provided with toothed surfaces for gripping an edge of wearing apparel 22 when the clamp 16 is closed thereon, the wearing apparel 22 being shown in phantom in FIG. 4. When the clamp is in its closed position as shown in FIG. 4, the spring 16*c* urges securely grip the wearing apparel.

Figure 4:
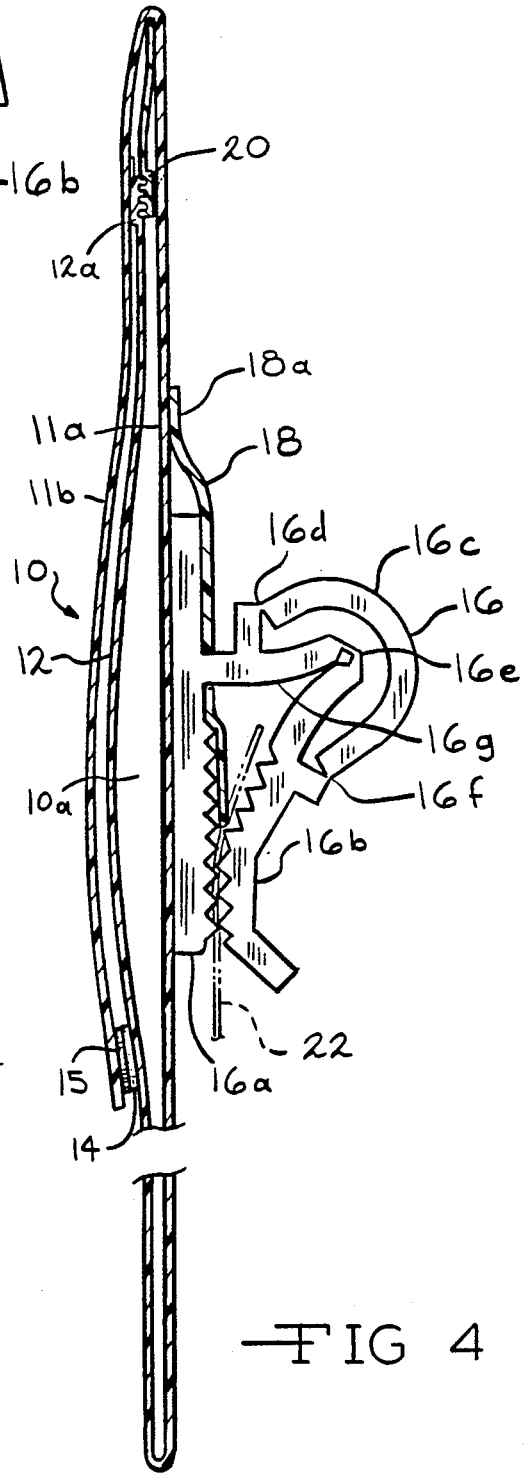
FIG. 4 is a sectional view taken generally along the line 4—4 of FIG. 2.

When not in use, the pouch 10 is generally flat with the rear wall 11*a* in contact with the front wall 12 throughout, but the walls are separable, as shown in FIG. 4, except at their lower and opposite side edges, to define a waterproof compartment 10*a* for receiving an item in the pouch.

Figure 6:
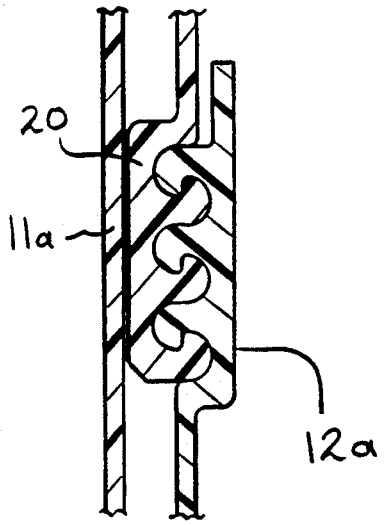
FIG. 6 is an enlarged, somewhat schematic, fragmentary vertical sectional view taken generally along the line 6—6 of FIG. 1 and showing a waterproof seal of the pouch in sealed condition.

With reference to FIGS. 1, 4 and 6, a flexible plastic sealing strip 12*a* is provided as an extension of the front wall 12, and a complementary sealing strip 20 is adhered to the upper edge portion of the inner side of the rear wall 11*a*. The sealing strips 12*a* and 20 are provided with releasably interlockable tongues and grooves, as shown in FIG. 6, for providing a waterproof seal.

To insert an item in the pouch 10, the closure flap 11*b* may be lifted by grasping a lower edge portion and pulling the VELCRO fastening strip 15 away from its complementary fastening strip 14. The sealing strip 12*a* may then be pulled away from the complementary sealing strip 20 to open the pouch. After the item is inserted, the strips 12*a* and 20 may be pressed together at their tongue and groove portions to form a waterprooof seal, and the closure flap 11*b* may be fastened in a closed position by pressing the fastening strips 14 and 15 together.

To clamp the pouch 10 to an item of clothing or the like, the operating lever 16*b* may be pulled upwardly to an open position with one hand while holding the mounting base 16*a* with the other hand. The lower toothed portion of the mounting base 16*a* may then be placed in overlying relationship with an item of clothing and the opening lever 16*b* may then be snapped back to the closed position to securely clamp the clothing between the operating lever and the mounting base.

It should be noted that various modifications may be made in the structure shown and described without departing from the spirit and scope of the attached claims.

I claim:

1. A waterproof pouch readily releasably clampable to wearing apparel, said pouchy comprising front and rear walls made of flexible impermeable sheet material and forming a compartment having an open top, first strip means disposed respectively adjacent the tops of said walls and forming a readily openable and recloseable waterproof seal for the open top of said compartment, a closure flap extending from said rear wall and being foldable over said front wall, second strip means disposed respectively on an inner side of said closure flap and on an outer side of said front wall and forming a readily openable and recloseable fastening means for securing the closure flap in a closed position, and a readily openable and closeable one-piece molded plastic over-center snap-acting clamp secured to an outer side of said rear wall for clamping he pouch to swearing apparel, said clamp including a mounting base, an operating lever pivotally connected to said mounting base, said base and said lever being provided with toothed surfaces in facing relationship with one another for securely gripping the wearing apparel, and spring means for biasing said toothed surfaces of said lever into engagement with said toothed surfaces of said base.

2. The waterproof pouch defined in claim 1 wherein said first strip means includes a flexible plastic sealing strip secured to an upper portion of the front wall, a complementary flexible plastic sealing strip secured to an upper edge portion of the rear wall on and inner side thereof, said sealing strip having tongues and grooves releasably interlockable with those of the other for providing a waterproof seal.

3. A waterproof pouch readily releasably clampable to wearing apparel, said pouch comprising a pair of complementary flexible plastic front and rear walls sealed to each other along lower edge potions and along opposite side edge portions, and flexible plastic sealing strip secured to an upper edge portion of the front wall, a complementary flexible plastic sealing strip secured to an upper edge portion o the rear wall on an inner side thereof, said sealing strips each having a tongue and a groove releasably interlockable with each of the other for providing a waterproof seal, a flexible plastic closure flap forming a extension of said rear wall and being foldable over said front wall, a pair of complementary readily openable and recloseable fastening strips adhered respectively to a lower edge portion of an inner side of said closure flap and to an outer side of said front wall, and a readily openable and closeable one-piece molded plastic over-center snap-acting clamp secured to an outer side of said rear wall for clamping the pouch to wearing apparel, said clamp including a mounting base, a fixed post secured to said base and extending outwardly therefrom, an operating lever pivotally connected to said post, said base and said lever being provided with toothed surfaces in facing relationship with one another for securely griping the wearing apparel, and spring means for biasing said toothed surfaces of said lever into engagement with said toothed surfaces of said base.

4. The invention defined in claim 3 wherein said sealing strips include a plurality of tongues and grooves releasably interlockable with those o the other for providing the waterproof seal.

* * * * *